US006742780B1

(12) United States Patent
Rudski

(10) Patent No.: US 6,742,780 B1
(45) Date of Patent: Jun. 1, 2004

(54) SKATE BOARD MAZE

(76) Inventor: Lewis Rudski, 1612 Beverly Dr., Los Angeles, CA (US) 90035

( * ) Notice: Subject to any disclaimer, the term of this patent is extended or adjusted under 35 U.S.C. 154(b) by 0 days.

(21) Appl. No.: 10/308,112

(22) Filed: Dec. 3, 2002

(51) Int. Cl.[7] ..... A63F 7/00

(52) U.S. Cl. ..... 273/109; 273/110; 273/118 R; 273/153 S

(58) Field of Search ..... 273/109–117, 153 R, 273/153 S, 118 R; D21/340

(56) References Cited

U.S. PATENT DOCUMENTS

| | | | | | |
|---|---|---|---|---|---|
| 625,845 | A | * | 5/1899 | Killey | 273/110 |
| 3,706,455 | A | * | 12/1972 | Meyer | 273/110 |
| 3,731,933 | A | * | 5/1973 | Grant | 273/113 |
| 3,924,852 | A | * | 12/1975 | Tamol | 273/443 |
| 4,006,902 | A | * | 2/1977 | Khawand | 273/113 |
| 4,076,245 | A | * | 2/1978 | Monroe | 463/69 |
| 4,142,724 | A | * | 3/1979 | Reick | 273/109 |
| 4,817,950 | A | * | 4/1989 | Goo | 463/36 |
| 5,130,693 | A | * | 7/1992 | Gigandet | 340/815.69 |
| 5,809,938 | A | * | 9/1998 | Baiera et al. | 119/707 |
| 5,860,861 | A | * | 1/1999 | Lipps et al. | 463/36 |
| 6,543,769 | B1 | * | 4/2003 | Podoloff et al. | 273/148 B |

FOREIGN PATENT DOCUMENTS

| | | | | |
|---|---|---|---|---|
| GB | 2016933 | * | 10/1979 | A63F/7/00 |

* cited by examiner

*Primary Examiner*—Raleigh W. Chiu
(74) *Attorney, Agent, or Firm*—Jonathan Grant; Grant Patent Services

(57) ABSTRACT

This invention discloses a skateboard maze game comprising a board having a surface, an underside, a front section, and a back section at least one maze grooved into the surface of the board, at east one ball per maze which fits into the grooves, and at least one ground support element. The board is positioned on top of wheels, half wheels or some other supporting structure, allowing an individual standing on the board to move the board around to work the maze.

20 Claims, 3 Drawing Sheets

SKATE BOARD MAZE

BACKGROUND OF THE INVENTION

1. Field of the Invention

This invention discloses a game that comprises a maze on the surface of a skate board type board.

2. Description of the Prior Art

Over the years, there have been a number of inventions for board mazes. U.S. Pat. No. 6,065,750 discloses a maze board game for providing an enjoying game for a number of players. The board game includes a base member and a generally transparent top member spaced above the base member. A middle board is interposed between the base member and the top member. The middle board is rotatably mounted to the base member. The middle board has a plurality of generally rectangular playing spaces arranged in a grid has a number of columns and a number of rows extending generally perpendicular to the columns. The playing spaces include a plurality of starting spaces, a plurality of barrier spaces, a plurality of exchange spaces, and a plurality of loss of turn spaces. The middle board also has a generally rectangular ending space.

U.S. Pat. No. 5,803,452 discloses a marble maze incorporated into a game board. The present invention playing surface is in the form of a maze of bumpers and railings, and a raised central area with indentations, all providing obstacle paths and capture points for playing marbles. Small, elongated sticks for flicking and moving the marbles are also provided.

U.S. Pat. No. 5,749,575 discloses a tiltable dual maze game board with rolling ball playing pieces. Each board is identical and can be tilted independently of the other to cause the playing pieces to move up ramps, around obstacles and around or into holes. Each board's control tilt mechanism includes two separate controller assemblies located perpendicular to each other under the board each of which has external handles. Each control assembly has two hinged vertical rods extending to join the board underneath by a ball joint connection. Ball bombs may be thrown from above in an attempt to knock out playing pieces before they reach the final winning hole.

U.S. Pat. No. 5,667,221 discloses an invention having two similar bearings or balls contained within a sealed tubular capsule. The capsule is comprised of a fully transparent material of a singular rigid substance. The capsule is composed of a lengthier playing field and two shorter storage compartments or traps. Each trap is situated at opposite ends of the playing field and accessed by each ball via an orifice of particular configuration. The configuration is such that the slope of the capsule wall leading out of the trap is at a greater angle to the longitudinal axis than the slope of the capsule wall leading into the trap is to the longitudinal axis. The objective of the game is to get a ball into each trap.

U.S. Pat. No. 5,615,882 discloses a maze game comprising a plurality of movable maze pieces, a maze board, a housing, having a polygonal shape and containing said maze board, and a top, having slots, restricting maze pieces movements. The maze pieces of substantially elongated shape, arc located in the top's slots, extending both inside the housing, being received by the maze board's passages, and outside to be controlled by the maze handler. When moved in the direction allowed by the slot where it is contained, the maze piece either move along the passage of the maze board, or, if the direction of the slot doesn't coincide with the passage, move the maze board, if other maze pieces allow such a movement. The object of the maze is to place the maze pieces from one predetermined position to another. There is further provided a 3D version of the maze game, comprising a maze body, sides of which are 2D mazes, located inside a transparent body, sides of which include cut through slots, housing elongated maze pieces, controlling movements of the inner maze body.

SUMMARY OF THE INVENTION

This invention discloses a "skateboard maze." Basically, a top portion of the skateboard deck has the design or configuration of a maze pattern. This maze pattern may be cut to any depth. The groove may be relatively shallow, such that at least the top part of the ball resides above the surface of the board when in the groove, or the groove may be carved deeper beneath the surface of the board, such that a maze ball can actually sit within and be enclosed by the groove, wherein the top part of the ball is below the surface of the board, and can move freely about freely within the grooves. The depth of the groove is dependant on the board thickness and small ball size.

To operate the maze game, an individual stands on the board, with feet placed on either end of the board. The board can be moved back and forth or side to side until the ball travels through the maze. Supporting elements of the skateboard maze are positioned under the board to allow the board to be rocked.

In one embodiment of the invention, wheels, half wheels, or supporting braces may be positioned on the underside of the board.

In another embodiment of the invention, there is a suspension system allowing for some "springiness" of the supporting elements.

In one embodiment of the invention, there is at least one maze.

In another embodiment of the invention, there are two mazes in the board.

In another embodiment of the invention, an artistic kit is included which allows for the painting and decoration of the skateboard.

DETAILED DESCRIPTION OF THE INVENTION.

Figure 1:
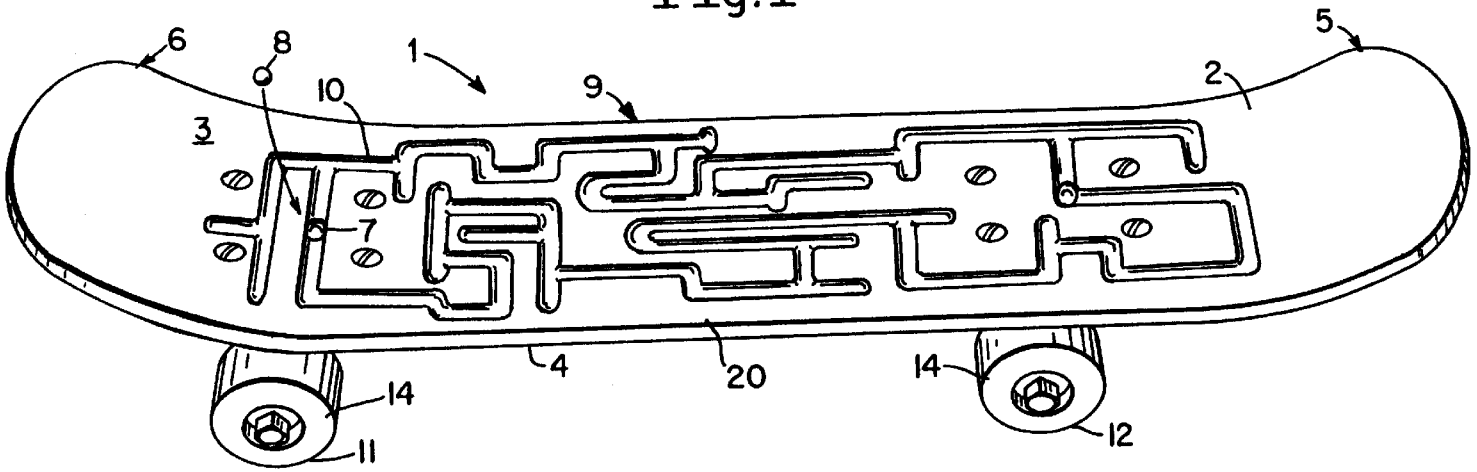
FIG. 1 is a perspective view of the skate board maze and ball.
Figure 2:
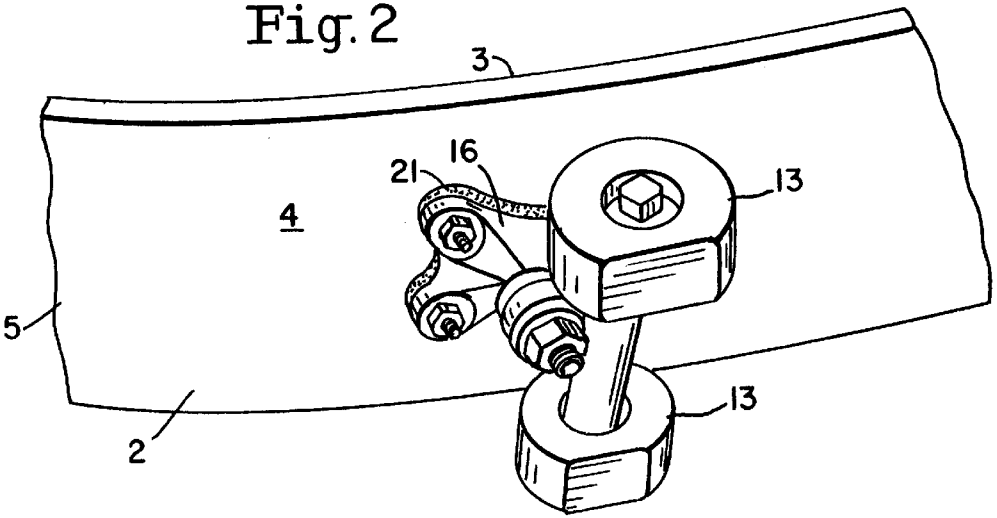
FIG. 2 is an underview of the skate board maze.
Figure 3:
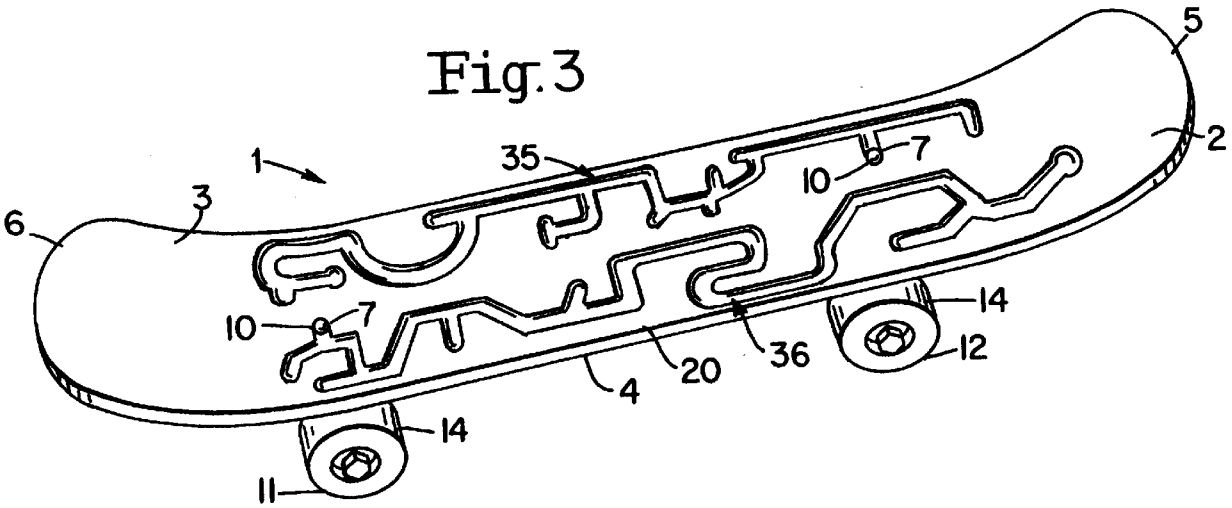
FIG. 3 is a top view of another skate board maze having two mazes.
Figure 4:
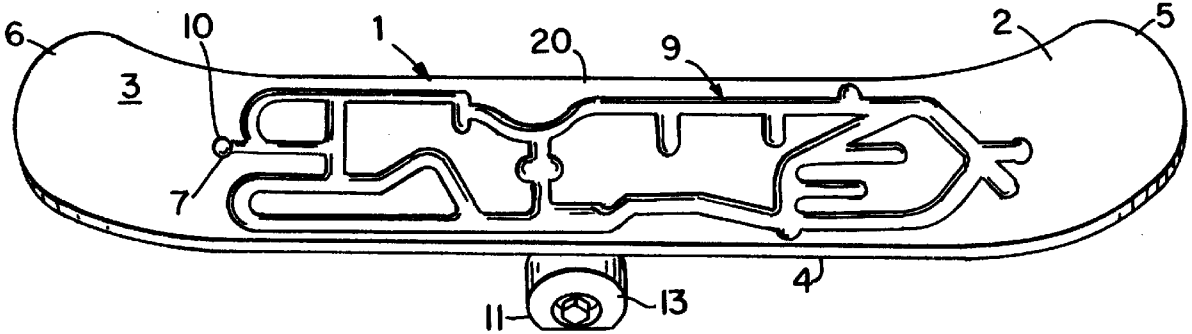
FIG. 4 is a perspective of another embodiment of the skateboard invention.
Figure 7:
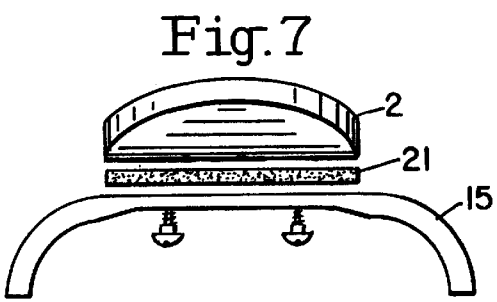
FIG. 7 is a perspective view of a mount used as a supporting element for the board.
Figure 6:
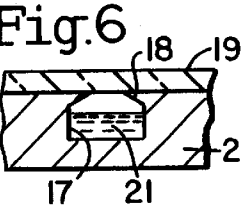
FIG. 6 is a cutaway side view of another skateboard invention.
Figure 5:
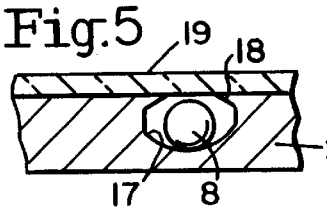
FIG. 5 is a cutaway side view of one embodiment of the skateboard invention.
Figure 8:
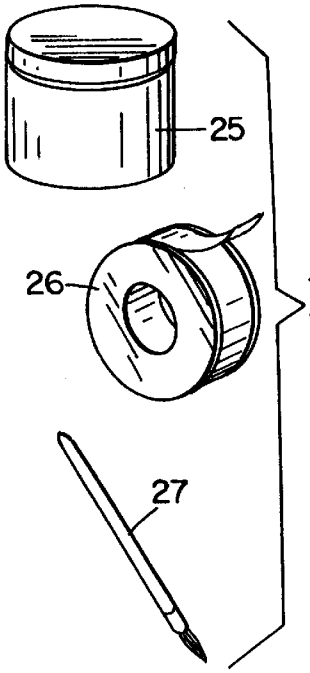
FIG. 8 is a perspective view of the art supplies that can be used to decorate the board.
Figure 9:
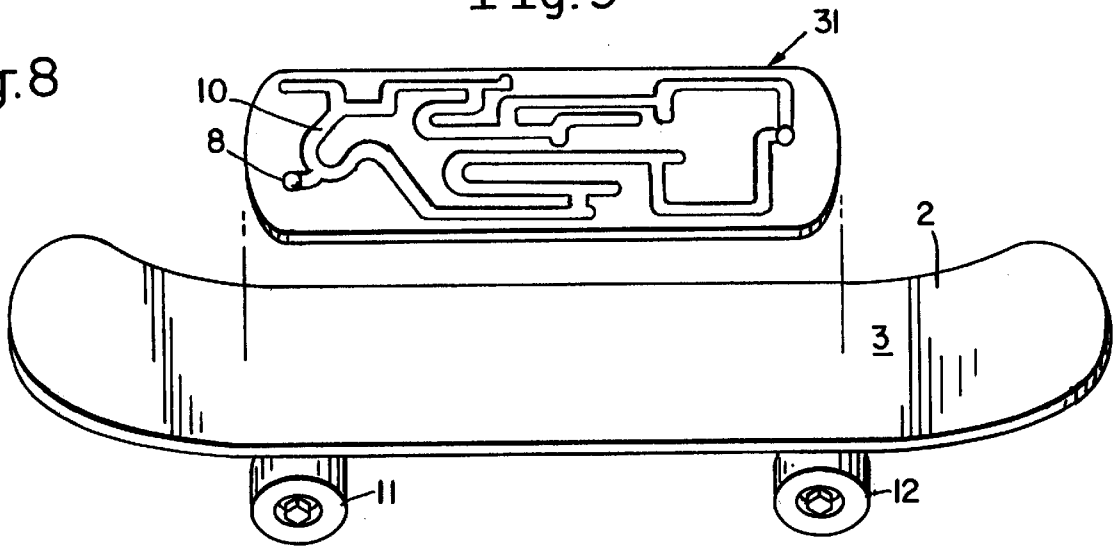
FIG. 9 is an a perspective view of the applique.

Referring to FIGS. 1–10, the skateboard maze 1 is comprised of a board 2 having a surface 3 and an underside 4.

The board 2 is preferably like a skateboard, wherein the front 5 and back 6 sections of the board are elevated at an upward angle to a middle section 20 of the board 2. The sections of the board are preferably integral with one another. The board itself may be made out of wood, plastic, resin, metal or a composite material. The board should be a standard skateboard about 24 inches long and about six inches wide; however, the board may be of any size and width that allows for balance and sturdiness. The range maybe from about 12 inches to even 36 inches in length, with a width of from about 4 inches to about twelve inches.

The board 2 has a maze 9 grooved into its surface 3. Preferably, the maze 9 will have a beginning or starting point 7, where a ball 8 will be placed at the start of the game, and an end, for when the ball 8 reaches the end of the maze. The ball may be made of glass, marble metal, plastic, composite, rubber, or any other material. The depth of the grooves 10 depends on the thickness of the board, 2 and on how difficult the operation of this game is to be. For instance, if the groove 10 is cut only 0.0625 (1/16) of an inch into the wood, it will be harder for the ball 8 to stay in the groove 10. A groove 10 that is cut deeper such as to 0.375 (3/8) of an inch or more will be easier to use.

When carved deep enough and wide enough, the groove may be carved deeper beneath the surface of the board, such that a maze ball 8 can actually sit within and be enclosed by the groove, wherein the top part of the ball is below the surface of the board, and can move freely within the grooves. The ball 8 can reside totally in the groove 17. Additionally, a lip 18 positioned over the groove 17 can help keep the ball 8 in the groove. The depth of the groove is dependant on the board 2 thickness and ball size.

In another design, a clear plastic, plexiglass, or see through cover 19 can cover the surface 3 of the board 2 when the groove 17 is deep enough and wide enough to engulf the ball 8. The top of the ball 8 can be at or beneath the surface of the board 2.

In another embodiment of the invention, in which there is a plastic or see through material, a liquid material 21 instead of ball 8 may be used to run the maze.

There may be more than one maze 9, and preferably two mazes 35, 36 on the board. Each maze requires its own ball 10. The mazes 9 may be parallel to one another with their starting points residing side by side, or the starting point of one maze 9 may be at the front 5 of the board 3 and the start point of the other maze 9 may be at the back 6 of the board 2.

In order to play this game, the player should have one foot at the front section 5 of the board 2, and the other foot at the back section 6 of the board 2 to most effectively rock the board 2 to and fro so that the little ball (which can be a marble, ball bearing or other similar round object) can go through the maze 9 to the end point. In order to do this, the board 2 most preferably is not lying on the ground.

Preferably on the underside 4 of the board 2 is at least one, and preferably two ground support elements 11. If there is one ground support element 11, that ground support element should be positioned in the middle 20 of the underside 4 of the board. As noted, however, it is preferable that there be two ground support elements 11 and 12, positioned where the wheels of a skateboard would be. More specifically, one ground support element 11 may be positioned at the back section 6 of the underside 4 of the board, and the other ground support element 12 may be positioned at the front section 7 of the underside 4 of the board.

The ground support element may be in the form of a half wheel 13, a wheel 14, a floating arch 15, or any other form. The ground support element is connected to the underside of the board by a truck or attachment element 16 which may be any standard means for connecting wheels. The wheels and half wheels may be exactly like those used for a skate board. Additionally, the wheels may attached to the underside of the board by means of skateboard trucks. It should be noted that the wheels are a set of two wheels, parallel to one another. The attachment element may be attached to the board by screws, glues, or any other means.

Additionally, there can also be a suspension or absorption system 21, giving a little bounce to the game when in use, and giving the user greater mobility. The suspension or absorption system can be as simple as a rubber pad 21 positioned between the wheel assembly (including the truck), or it can be a spring suspension system found on some deluxe skateboards. Most any suspension system is suitable.

Some people who use skateboards like to personalize them. The skateboard maze game may optionally come with art supplies, such as paints, preferably specialized water based acrylic nontoxic paints 25, nonskid tape 26, and brushes 27.

While the grooves maybe made directly into the surface of the skateboard 2, an applique 31 may be applied to surface of an ungrooved surface. The applique 31 has cut within it grooves forming a maze. This applique 31 may be glued or screwed onto the skateboard 2.

As various changes could be made in the above constructions without departing from the scope of the invention, it is intended that all matter contained in the above description or shown in the accompanying drawings shall be interpreted as illustrative and not in a limiting sense.

I claim:

1. A skateboard maze game, said game comprising:

a board, said board having a surface, an underside, a front section, and a back section;

at least one maze grooved into the surface of the board; said maze being comprised of grooves;

at least one ball per maze which fits into said grooves; and at least one ground support element, the at least one ground support element being selected from the group consisting of a half wheel, a wheel, skate board wheels, skate board half wheels, and a floating arch wherein said at least one said ground support element is positioned on the underside of the board.

2. The skateboard maze game of claim 1, wherein said board is comprised of a material selected from the group consisting of wood, plastic, resin, metal and a composite material.

3. The skateboard maze game of claim 1, wherein said front section and said back section of said board are elevated at an upward angle to a middle section of the board.

4. The skateboard maze of game 1, wherein said ball is comprised of a material selected from the group consisting of glass, marble metal, plastic, composite, and rubber.

5. The skateboard maze game of claim 1, wherein said game comprises at least two ground support elements.

6. The skateboard maze game according to claim 1, wherein each said attachment element is a skate board truck.

7. The skateboard maze game according to claim 1, wherein the length of aid board ranges from about twelve inches to about thirty six inches long, and from about four inches to about twelve inches wide.

8. The skateboard maze game according to claim 1, wherein said groove is large enough such that the ball is entirely in the groove, at or beneath the surface of the board.

9. The skateboard maze game according to claim 1, further comprising a lip positioned over said groove keeping said ball in the groove.

10. The skateboard maze game according to claim 1, further comprising craft materials selected from the group consisting of paints, brushes, and nonskid tapes for decorating said board.

11. A skateboard maze game, said game comprising:

a board, said board having a surface, an underside, a front section, and a back section;

at least one maze grooved into the surface of the board; said maze being comprised of grooves;

a limited amount of fluid per maze which fits into said grooves; and at least one ground support element, the at least one ground support element being selected from the group consisting of a half wheel, a wheel, skate board wheels, skate board half wheels, and a floating arch, and said at least one said ground support element being positioned on an underside of the board.

12. The skateboard maze game of claim 11, wherein said board is comprised of a material selected from the group consisting of wood, plastic, resin, metal and a composite material.

13. The skateboard maze game of claim 11, wherein a front section and said back section of said board are raised.

14. The skateboard maze game of claim 11, wherein said game comprises at least two ground support elements.

15. The skateboard maze game according to claim 11, wherein each of the at least one ground support element is connected to the underside of the board by an attachment element which may be any standard means for connecting wheels.

16. The skateboard maze game according to claim 15, wherein each said at least one attachment element is a skate board truck.

17. The skateboard maze game according to claim 11, wherein the length of aid board ranges from about twelve inches to about thirty six inches long, and from about four inches to about twelve inches wide.

18. The skateboard maze game according to claim 11, wherein said groove is large enough such that a ball is entirely in the groove, at or beneath the surface of the board.

19. The skateboard maze game according to claim 18, further comprising a lip positioned over said groove keeping said ball in the groove.

20. The skateboard maze game according to claim 11, further comprising craft materials selected from the group consisting of paints, brushes, and nonskid tapes to decorate said board.

* * * * *